US008159401B2

(12) United States Patent
Hao et al.

(10) Patent No.: US 8,159,401 B2
(45) Date of Patent: Apr. 17, 2012

(54) ANTENNA FOR SEALED TRANSMITTER ASSEMBLY IN SUBSURFACE UTILITY INSTALLATIONS

(75) Inventors: Jin Hao, Fox Point, WI (US); Chang Thao, Milwaukee, WI (US)

(73) Assignee: Badger Meter, Inc., Milwaukee, WI (US)

( * ) Notice: Subject to any disclaimer, the term of this patent is extended or adjusted under 35 U.S.C. 154(b) by 440 days.

(21) Appl. No.: 12/355,223

(22) Filed: Jan. 16, 2009

(65) Prior Publication Data

US 2010/0182204 A1 Jul. 22, 2010

(51) Int. Cl.
*H01Q 1/38* (2006.01)
*H01Q 1/24* (2006.01)

(52) U.S. Cl. ..... 343/702; 343/700 MS

(58) Field of Classification Search ..... 343/700 MS, 343/702, 767, 846, 850, 860, 876, 895
See application file for complete search history.

(56) References Cited

U.S. PATENT DOCUMENTS

| | | | | |
|---|---|---|---|---|
| 6,002,367 | A | 12/1999 | Engblom et al. | |
| 6,344,823 | B1 * | 2/2002 | Deng | 343/700 MS |
| 6,404,394 | B1 * | 6/2002 | Hill | 343/702 |
| 6,535,167 | B2 | 3/2003 | Masuda et al. | |
| 6,992,627 | B1 * | 1/2006 | Honda et al. | 343/700 MS |
| 7,154,443 | B2 | 12/2006 | Inaba et al. | |
| 7,598,921 | B2 * | 10/2009 | Ge et al. | 343/806 |
| 7,760,146 | B2 * | 7/2010 | Ollikainen | 343/702 |
| 7,903,034 | B2 * | 3/2011 | Anguera et al. | 343/702 |
| 2003/0025637 | A1 | 2/2003 | Mendolia et al. | |
| 2004/0207557 | A1 * | 10/2004 | Chen et al. | 343/702 |

FOREIGN PATENT DOCUMENTS

JP 0825 0925 A 9/1996

* cited by examiner

*Primary Examiner* — Douglas W Owens
*Assistant Examiner* — Chuc Tran
(74) *Attorney, Agent, or Firm* — Boyle Fredrickson, S.C.

(57) ABSTRACT

An antenna (14, 15) for installation in a subsurface ground enclosure has an F-shaped radiating element (15) having a rectangular strip (15*c*) disposed on edge and two spaced apart bars (15*a*, 15*b*) disposed substantially perpendicular to the rectangular strip (15*c*) for connection to a first edge of a circuit board (31) and an L-shaped ground plane extension element (14) extending from a second edge (31*b*) of the circuit board (31) and then turning substantially perpendicular downward to provide a longer ground plane within a confined rectangular space. The antenna (14, 15) is dimensioned so as to be tuned to a resonant frequency in a range from 450 Mhz to 470 Mhz.

8 Claims, 2 Drawing Sheets

ANTENNA FOR SEALED TRANSMITTER ASSEMBLY IN SUBSURFACE UTILITY INSTALLATIONS

TECHNICAL FIELD

This invention relates to automatic meter reading (AMR) systems for collecting meter data signals over a geographical area, such as a municipality or municipal utility district, and more particularly to transmitter assemblies for location in subsurface utility enclosures installed in the ground.

DESCRIPTION OF THE BACKGROUND ART

In moderate climate zones, utility meters, particularly water meters, are located in subsurface enclosures in areas near residences or other dwellings. Such enclosures are referred to as "pits." An example of such enclosure is illustrated in Cerny et al., U.S. Pat. No. 5,298,894, issued Mar. 29, 1994, and assigned to the assignee of the present invention. In these systems, a transmitter or transceiver, and an associated antenna, are enclosed in one or more sealed enclosures which are located in a larger pit for the water meter. The antenna must be assembled in a housing in which the electronics are encapsulated for moisture protection. The assemblies for the transmitter and antenna must be fairly compact to be mounted inside the pit enclosure. However, generally, the encapsulant should not contact the antenna and it may alter its performance due to capacitive effects of a dielectric material.

The invention provides an antenna for radiating at a specified frequency and sufficient gain to transmit signals to receivers in fixed networks as far away as possible for the available power. Typically, the transmitter assembly is powered by one or more batteries. Prior antennas have been able to transmit satisfactorily up to about 0.5 mile. With the antenna of the present invention, it is to increase this distance up to about 1.0 mile.

Therefore, the invention will enable one to provide an improved antenna in a transmitter assembly for installation in a subsurface enclosure.

SUMMARY OF THE INVENTION

The invention provides an antenna for a transmitter assembly for installation in a subsurface utility enclosure.

The antenna has an F-shaped element with two cross bars extending to one orthogonal edge of a circuit board, and a stem portion that is bent at approximately ninety degrees from the plane of the circuit board. The antenna also has an L-shaped ground plane extending from a second edge of the circuit board orthogonal to the first edge of the circuit board, the ground plane also having a portion bent at approximately ninety degrees from the plane of the circuit board to provide a compact lateral area for the assembly without increasing a height of the assembly. The F-shaped element and the L-shaped element are preferably made of a conductive metallic sheet material.

The antenna is dimensioned such that it is tuned to a resonant frequency in a preferred range from 450 Mhz to 470 Mhz.

The antenna provides the necessary range for a transmitter for reaching receivers in a fixed network while keeping the size of the assembly very compact.

Other aspects of the invention, besides those discussed above, will be apparent to those of ordinary skill in the art from the description of the preferred embodiments which follows. In the description, reference is made to the accompanying drawings, which form a part hereof, and which illustrate examples of the invention.

DETAILED DESCRIPTION OF THE PREFERRED EMBODIMENT

Figure 1:
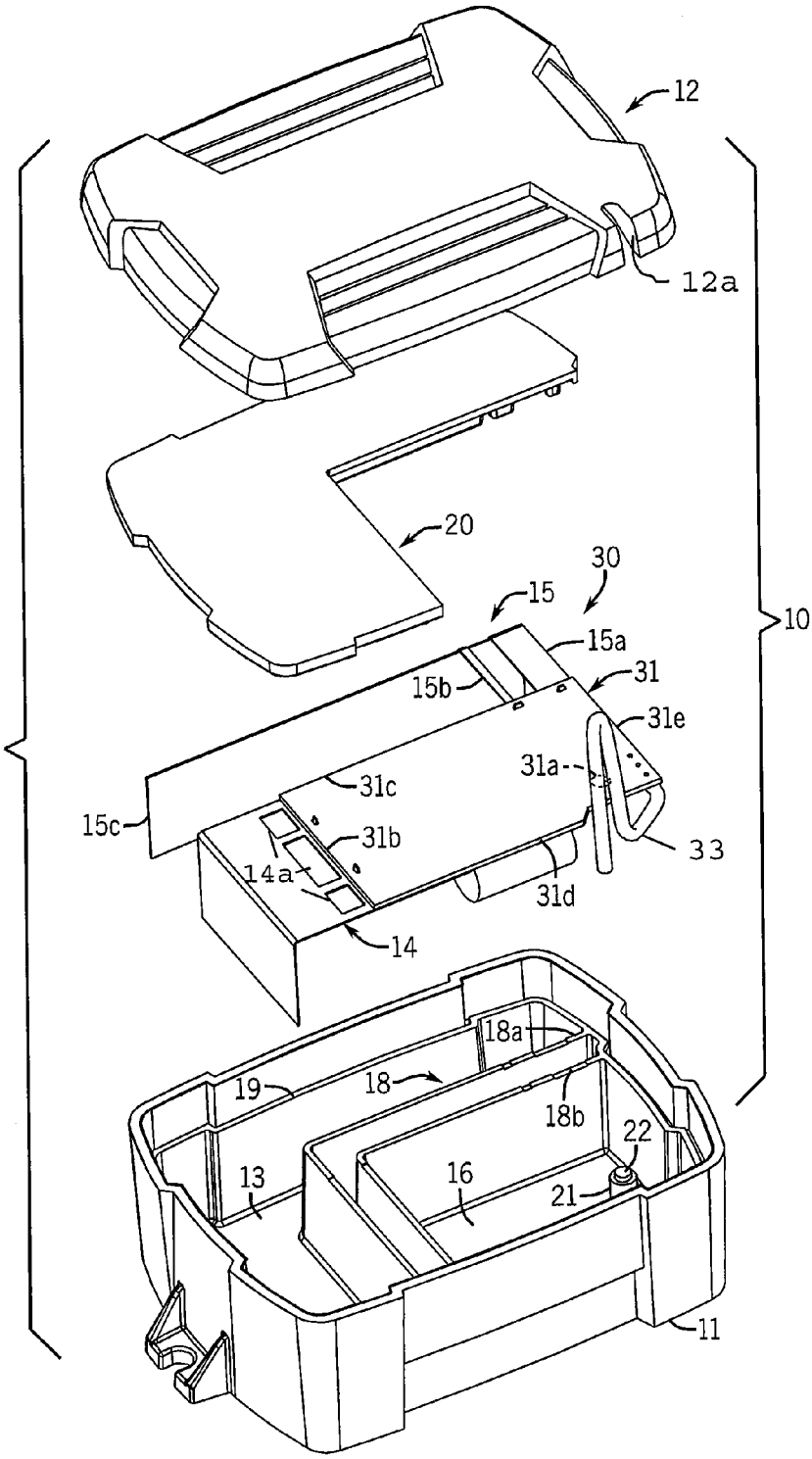
FIG. 1 is an exploded perspective view of the assembly including the antenna of the present invention.
Figure 2:
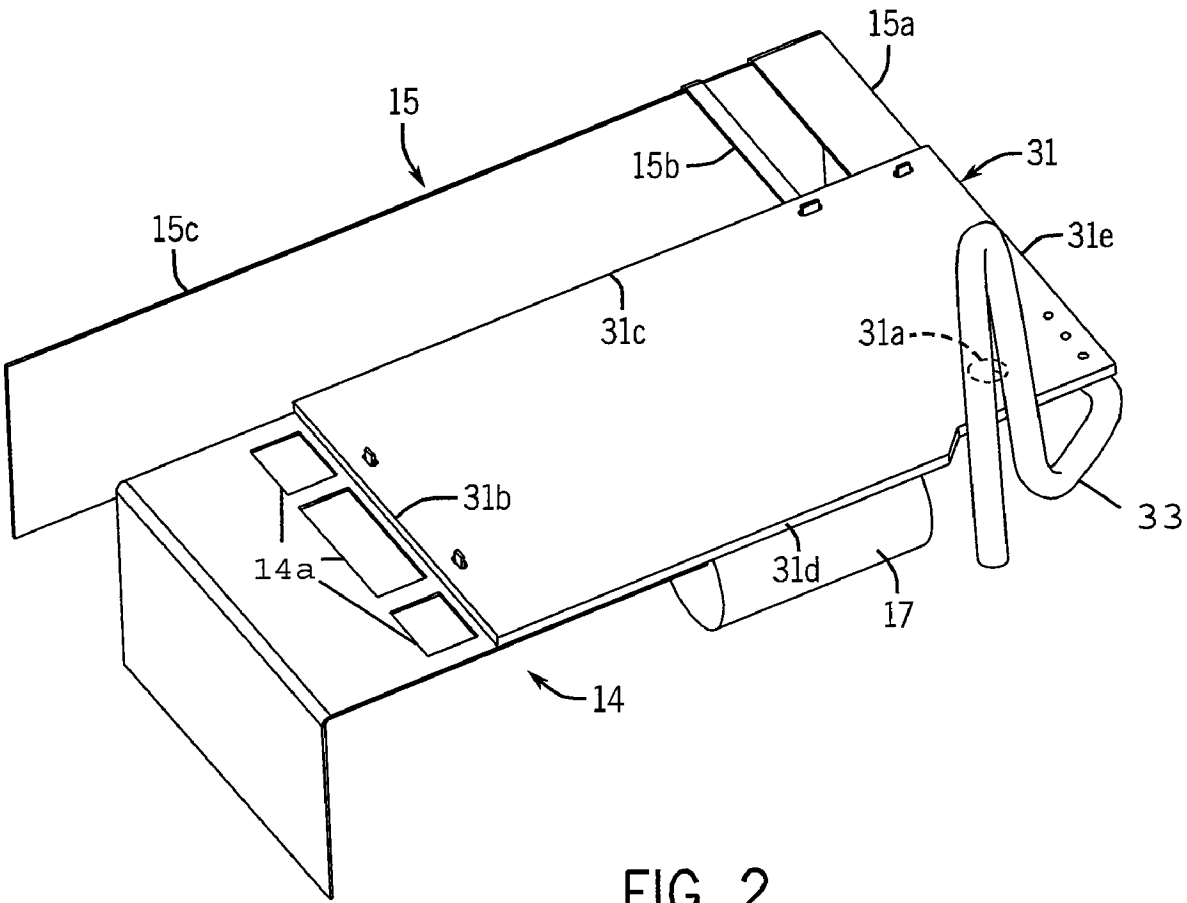
FIG. 2 is detail perspective view of the circuit board portion of the assembly.

Referring to FIG. 1, the assembly 10 of the present invention has a housing with a bottom portion 11 and a lid 12 of non-metallic, non-RF interfering material. The bottom housing portion 11 has an L-shaped antenna compartment 13 for receiving the antenna 14, 15 and a rectangular battery compartment 16 for receiving at least one battery 17 and an upstanding L-shaped interior barrier 18 of two upstanding spaced apart and parallel walls 18*a*, 18*b* separating the antenna compartment 13 and the battery compartment 16. The spacing in the antenna compartment 13 between the walls 18*a*, 18*b* and the outer wall of the housing bottom portion 11 has been slightly exaggerated in FIG. 1. Inside the housing bottom portion is an interior ledge 19 for supporting a circuit board assembly 30 and an L-shaped cover 20 seen in FIG. 1. In addition a post 21 is situated in the battery compartment 16 with a projection 22 for receipt in a hole 31*a* in the circuit board 31. A cable 33 enters the housing through a slot opening 12*a* in the lid 12 and connects to the circuit board 3 near edge 31*e*. The circuit board 31 receives signals from a meter register or meter encoder through the cable 33 representing units of consumption of a utility, and these are converted to radio frequency signals for transmission through the antenna 14, 15.

A circuit board assembly 30 includes a circuit board 31 with circuitry for a radio transmitter. Although the invention is disclosed in the context of a transmitter, it is also applicable to a transmitter combined with a receiver ("transceiver") for two-way communication, the term "transmitter should be understood to include a part of a transceiver. An L-shaped metal ground plane element 14 of conductive material extends from one edge 31*b* of the circuit board 31 and has a portion bent at a 90-degree angle to the extending portion. The antenna 14, 15 is designed to operate in a range from 450 Mhz to 470 Mhz. The L-shaped element 14 has some cut-out portions 14*a* near the edge 31*b* of the circuit board 31. The antenna 14, 15 is designed to obtain resonant operation at 460 Mhz, at a highest available power by controlling the dimensions of the ground plane 14 and the radiating element 15. The ground plane 14 and the circuit board 31 together have a length of 105 mm. If one part is shortened the other part must be lengthened to retain this dimension.

An F-shaped metal radiating element 15 extends from another edge 31*c* of the circuit board 31 that is orthogonal to the first edge 31*b*. The F-shaped element 15 includes a wider top bar 15*a*, which serves as a shorting member, and a narrower middle bar 15*b* that serves as a conductive member for the radiating energy to a broad, flat, F-stem strip 15*c* that is bent at a 90-degree angle to the two cross bars 15*a*, 15*b*. The F-stem also extends for 105 mm. The minimum dimension for the F-shaped element 15 and the L-shaped ground plane would be 165 mm, which is ¼ of a 660 mm wavelength provided at 460 Mhz. The F-shaped element 15 and the L-shaped element were made longer to obtain resonant operation and higher gain. The antenna 14, 15 extends from two orthogonal edges 31*b*, 31*c* of the circuit board 31 in a plane defined by the circuit board with two portions bent at approximately ninety degrees from the plane of the circuit board 31 to provide a compact area-to-height aspect ratio. Although gain is reduced by the bending the two portions, it is more than made up for by the added length of the ground plane 14. The F-shaped element and the L-shaped element are preferably made of a conductive metallic sheet material.

The battery 17 is encapsulated with a sealing material (not shown) in the battery compartment 16 and the interior barrier 18 forms a support for the printed circuit board 31 as well as a barrier against the intrusion of sealant into the antenna compartment 16 in which the antenna 14, 15 is disposed when the unit 10 is assembled. An internal cover element 20 is disposed around the printed circuit board 31 and over the antenna compartment 13 and the antenna 14, 15 to provide a second barrier against the entry of sealing material into the antenna compartment 13.

A sealing material (not shown) is disposed in the battery compartment to protect the battery 17 from moisture. Sealing material is also disposed on both sides of the printed circuit board and at the location where an edge of the cover element 20 meets an inner wall of the housing bottom portion 11. The sealing material is not disposed in the antenna compartment 13 or in contact with the antenna 14, 15, except along the edges of the circuit board 31, so as not to affect the operation of the antenna 14, 15, due to a capacitive effect that the material would have on the electrical properties of the antenna 14, 15.

Encapsulation of the electronics is necessary, because, the outer housing of thermoplastic material 11, 12, is not impervious to water.

In a method of assembly, the circuit board 31 is positioned over the barrier 18 within a housing bottom portion 11. The portions of the antenna 14, 15 extending from edges 31*b*, 31*c* of the circuit board are placed into corresponding portions of the antenna compartment 13. The cover 20 is positioned around the circuit board 31 and over the antenna compartment 13 to shield the antenna compartment 13 from most of the encapsulating material. Encapsulating material (not shown) is injected into the space above the circuit board 31 and down around an edges 31*d*, 31*e* of the circuit board 31 separated by a gap from the outer wall of the housing bottom portion 11 such that encapsulating material flows into the battery compartment 16, and fills the battery compartment 16 to cover the battery 17 and encapsulate the bottom side of the circuit board 31. For a drawing of the encapsulant, reference is made to a copending application of the assignee filed on even date herewith and entitled "Sealed Transmitter Assembly for Subsurface Utility Installations." The encapsulant, also referred herein to as sealing material, then seals both top and bottom sides of the circuit board 31, the battery 17 or batteries and the cable 33 in the battery compartment 16 and any seam between the sealing cover 20 and inside wall of the bottom housing portion 11 and any gap between the circuit board 31 and the inside wall of the housing bottom portion 11. The housing lid 12 is then placed over the housing bottom portion 11 to enclose the assembly 10. It may be secured to the housing bottom 11 by a snap fit or other known methods.

Once the assembly 10 is assembled it may be installed in a pit enclosure, with the use of a bracket of the type disclosed in Bublitz et al., U.S. Pat. No. 6,378,817, that mounts the assembly 10 some distance under the pit lid or by fastening the assembly directly underneath the pit lid. It is assumed in this instance that the pit lid is made of a non-metallic material that does not interfere with radio signals to any great extent.

This has been a description of a preferred embodiment, but it will be apparent from the above description that variations of a type that are apparent to one of ordinary skill in the art may be made in the details of other specific embodiments without departing from the scope and spirit of the present invention, and that such variations are intended to be encompassed by the following claims.

We claim:

1. A radio frequency transmitter assembly for disposition in a subsurface utility enclosure, the assembly comprising:

a circuit board supporting radio frequency transmitter circuitry, the circuit board having at least two orthogonal edges;

an antenna having an F-shaped element with two cross bars extending from a first edge of the circuit board, said cross bars extending in a plane defined by the circuit board, and the F-shaped element having a stem portion bent at approximately ninety degrees from the plane of the circuit board;

the antenna also having an L-shaped ground plane element with a portion extending from a second edge of the circuit board orthogonal to the first edge of the circuit board, said portion extending from the second edge in the plane defined by the circuit board, the L-shaped ground plane element also having a portion bent at approximately ninety degrees from the plane of the circuit board, to provide a compact lateral area for the assembly without increasing a height of the assembly, and wherein the L-shaped ground plane element and the stem portion of the F-shaped element extend to a common length to increase an overall gain of the antenna.

2. The assembly as recited in claim 1, wherein the antenna is dimensioned so as to be tuned to a resonant frequency in a range from 450 Mhz to 470 Mhz.

3. The assembly as recited in claim 1, wherein the F-shaped element and the L-shaped ground plane element are each formed of a conductive metallic sheet material.

4. The assembly as recited in claim 1, wherein the stem portion extends to a length of 105 mm.

5. An antenna for a radio frequency transmitter assembly for disposition in subsurface utility enclosures, the antenna comprising:

a circuit board;

an F-shaped radiating element having a rectangular stem portion disposed on edge and two spaced apart bars disposed substantially perpendicular to the rectangular stem portion for connection to a first edge of the circuit board with the two spaced apart bars being positioned in a plane defined by the circuit board;

an L-shaped ground plane extension element extending from a second edge of the circuit board in the plane defined by the circuit board and then turning substantially perpendicular downward to provide a longer ground plane within a confined rectangular space, and wherein the L-shaped ground plane extension element and the stem portion of the F-shaped element extend to a common length to increase an overall gain of the antenna.

6. An antenna as recited in claim 5, wherein the antenna is dimensioned so as to be tuned to a resonant frequency in a range from 450 Mhz to 470 Mhz.

7. The antenna as recited in claim 5, wherein the F-shaped element and the L-shaped ground plane extension element are each formed of a conductive metallic sheet material.

8. The antenna as recited in claim 5, wherein the stem portion extends to a length of 105 mm.

* * * * *